US007192256B2

(12) United States Patent
Bachofner et al.

(10) Patent No.: US 7,192,256 B2
(45) Date of Patent: Mar. 20, 2007

(54) ROTOR END PIECE

(75) Inventors: René Bachofner, Neuenhof (CH); Petra Fabijan, Maegenwil (CH); Wolfgang Kappis, Fislisbach (CH); Michael Mueller, Ulm (DE)

(73) Assignee: Alstom Technology Ltd., Baden (CH)

( * ) Notice: Subject to any disclaimer, the term of this patent is extended or adjusted under 35 U.S.C. 154(b) by 80 days.

(21) Appl. No.: 10/792,708

(22) Filed: Mar. 5, 2004

(65) Prior Publication Data

US 2004/0179945 A1 Sep. 16, 2004

(30) Foreign Application Priority Data

Mar. 11, 2003 (DE) ..... 103 10 432

(51) Int. Cl.
*F01D 5/32* (2006.01)

(52) U.S. Cl. ..... 416/212 A; 416/215; 416/220 R

(58) Field of Classification Search ..... 416/218, 416/220 R, 215, 217, 219 R, 216, 204 A, 416/212 A, 214 A
See application file for complete search history.

(56) References Cited

U.S. PATENT DOCUMENTS 1,371,327 A * 3/1921 Schneider ..... 416/215
2,406,703 A * 8/1946 Morris ..... 416/216

FOREIGN PATENT DOCUMENTS

| | | |
|---|---|---|
| CH | 223599 | 9/1942 |
| DE | 812337 | 8/1951 |
| DE | 820598 | 11/1951 |
| DE | 271243 | 8/1989 |
| DE | 10134611 A1 * | 6/2002 |
| EP | 1215367 | 11/2002 |
| GB | 674543 | 6/1952 |

OTHER PUBLICATIONS

Search Report from DE 103 10 432.3 (Mar. 11, 2003).
Copy of Search Report for EP App. No. 04100742 (Jun. 27, 2006).

* cited by examiner

*Primary Examiner*—Richard A. Edgar
(74) *Attorney, Agent, or Firm*—Cermak & Kenealy, LLP; Adam J. Cermak

(57) ABSTRACT

The invention relates to a rotor end piece (1) for rotors (2) of thermal turbomachines with a circumferential slot (3), consisting of two end piece halves (4, 4') having side faces (5, 5') opposite one another in the installed state and of a wedge (6) which is pushed in between them and which, in the installed state, is anchored in the side faces (5, 5') of the end piece halves (4, 4') in a form-fitting manner, the rotor end piece (1) being arranged in the axial direction of the rotor (2) between two moving blades (7, 7'). It is characterized in that each of the end piece halves (4, 4') is fastened in the axial direction of the rotor (2) to the two adjacent moving blades (7, 7') by means of one interlocking connection (8, 8', 9, 9') each. These four interlocking connections (8, 8', 9, 9'), instead of the rotor (2), now absorb the axial forces which are caused by the centrifugal force and the caulked wedge (6). In this way, disturbing rotor vibrations are advantageously avoided.

12 Claims, 2 Drawing Sheets

ROTOR END PIECE

TECHNICAL FIELD

The invention relates to the field of power plant technology. It relates to a rotor end piece for rotors of thermal turbomachines according to the preamble of patent claim 1.

PRIOR ART

Thermal turbomachines, such as turbines and compressors, essentially comprise a rotor fitted with moving blades and a stator in which the guide blades are suspended.

The task of the fixed guide blades is to direct the flow of the gaseous medium to be compressed or expanded onto the rotating moving blades in such a way that the energy conversion is effected with the best possible efficiency.

Both moving blades and guide blades essentially have an airfoil and a blade root. In order to be able to fasten the moving blades on the rotor or the guide blades in the stator, slots are recessed in the stator and on the rotor shaft. The roots of the blades are pushed into these slots and locked there.

It is known that most compressor blade rows of gas turbine rotors are arranged in circumferential slots. During the fitting of such blade rows, a special solution has to be found for the last blades to be fitted, since the remaining filling opening has then become too small. This residual opening is filled with a "rotor end piece". The rotor end piece consists of an intermediate piece divided in half (two end piece halves) and of a wedge, by means of which the end piece halves are caulked in the rotor. The rotor end piece is therfore supported in the axial direction on the rotor. In this known prior art, the two end piece halves each have a straight side face, which at its top end forms a projecting lug with the top surface of the end piece half. Said side faces are opposite one another in the installed state, the wedge then being located between them. Once the two end piece halves and the wedge have been installed, the lugs of the two end piece halves are finally caulked via the wedge.

A disadvantage with this prior art is that the wedge, on account of the tilting moment of the two end piece halves, which is caused by the centrifugal force during operation, is able to bend open the caulked lugs. The wedge can thus fly out of the compressor and complete compressor damage may occur.

This disadvantage can certainly be removed by an invention of the applicant which has still not been published and in which the wedge is prised open and the lugs of the prised-open wedge are anchored in a heart-shaped cavity formed by the side faces of the two end pieces.

However, a disadvantage with these technical solutions consists in the fact that the end pieces exert axial forces on the rotor, on the one hand due to the centrifugal force during operation and on the other hand due to the caulking of the wedge. In the search for the causes of the frequently occurring rotor vibrations, it has been found that these axial forces can bend the rotor and thereby adversely generate disturbing vibrations.

DESCRIPTION OF THE INVENTION

The aim of the invention is to avoid said disadvantages of the prior art. The object of the invention is to develop a rotor end piece which exerts no axial forces on the rotor, so that an occurrence of disturbing rotor vibrations caused by axial forces is thereby avoided.

According to the invention, this object is achieved in a rotor end piece for rotors of thermal turbomachines according to the preamble of patent claim 1 in that the rotor end piece is fastened in the axial direction to the two adjacent moving blades. Each of the two end piece halves of the rotor end piece is fastened in the axial direction of the rotor to the two adjacent moving blades by means of one interlocking connection each.

The advantages of the invention consist in the fact that it is now the two blades, and not the rotor as in the prior art, which absorb the axial forces caused by the centrifugal force and the prised open wedge. As a result, disturbing vibrations are advantageously avoided.

The interlocking connection can be designed to be straight or a form fit. If the end piece halves and the adjacent moving blades form a form-fitting subassembly, this has the additional advantage that the adjacent blades are not turned into the rotor by the forces acting on them from the end piece, so that they do not jam during their thermal expansion.

It is expedient if the wedge, at its top end, has two lugs which are separated from one another by a longitudinal slot and which are spread out in the installed state, and if the side faces of the end piece halves each have a recess in the top region, these recesses forming a roughly heart-shaped cavity in the installed state, the walls of this cavity being covered by the spread-out lugs of the wedge, and the wedge being firmly anchored in the end piece halves as a result. The spreading-out of the wedge into the heart shape of the two end piece halves avoids a situation in which the wedge can break away from its anchorage during operation.

BRIEF DESCRIPTION OF THE DRAWINGS

Several exemplary embodiments of the invention are shown in the drawing, in which.

In each case the same items are provided with the same designations in the figures. The effective direction of the axial force is designated by arrows.

WAYS OF IMPLEMENTING THE INVENTION

The invention is explained in more detail below with reference to exemplary embodiments and FIGS. 1 to 4.

Figure 1:
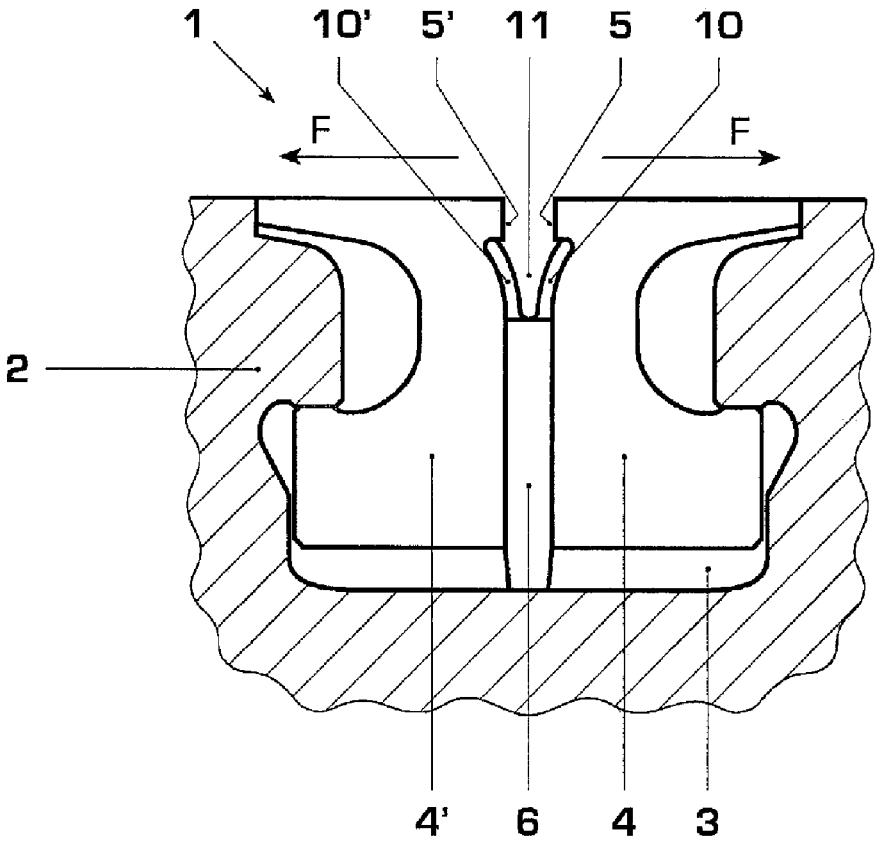
Fig. 1 (Prior Art)
FIG. 1 shows a section through a rotor end piece known to the applicant after it has been installed in a compressor rotor.

FIG. 1 shows a section through a rotor end piece 1 known to the applicant after it has been installed in a rotor 2.

The rotor end piece 1 shown in FIG. 1 consists of two end piece halves 4, 4' with side faces 5, 5' opposite one another and of a wedge 6 which, at its top end remote from the rotor longitudinal axis in the installed state, has two lugs 10, 10' separated from one another by a longitudinal slot. The side faces 5, 5' of the end piece halves 4, 4' each have a recess in the top region, these recesses forming a roughly heart-shaped cavity 11 in the installed state, the walls of this cavity 11 being covered by the spread-out lugs 10, 10' of the caulked wedge 6 and in this way firmly anchoring the wedge 6 in the heart-shaped cavity 11 in a form-fitting manner. In this embodiment known to the applicant, the rotor end piece 1 or the end piece halves 4, 4' is/are supported on the rotor in the axial direction.

A disadvantage with these technical solutions consists in the fact that the end pieces 4, 4' exert axial forces F on the rotor 2, on the one hand due to the centrifugal force during operation and on the other hand due to the caulking of the wedge 6. In the search for the causes of the frequently occurring rotor vibrations, it has been found that these axial forces F can bend the rotor 2 and thereby adversely generate disturbing vibrations.

A technical solution (see FIGS. 2 to 4) is therefore proposed in which the rotor end piece is no longer supported in the axial direction on the rotor but on the two adjacent end piece blades, to be precise on the blade roots.

Figure 2:
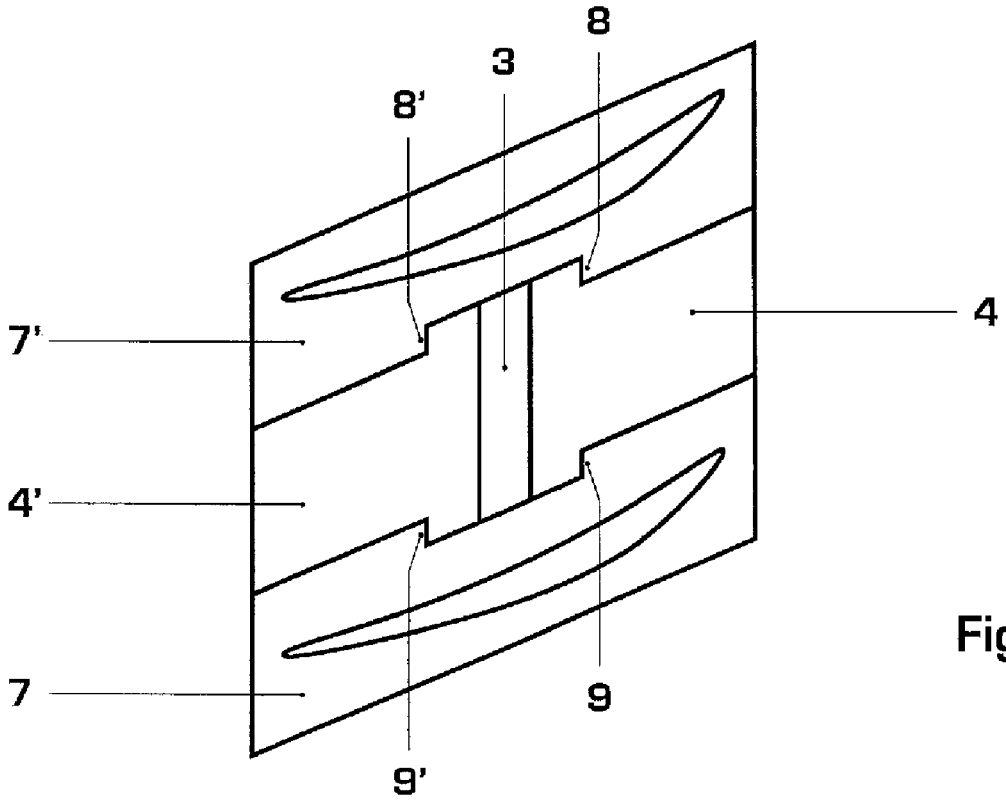
FIG. 2 shows a plan view of a schematically represented rotor end piece according to the invention with straight interlocking connection after it has been installed in a compressor rotor (without wedge)

A plan view of a schematically represented rotor end piece 1 according to the invention after installation with a straight interlocking connection 8, 8', 9, 9' is shown in FIG. 2. The caulked wedge, which fills the residual opening of the circumferential slot 3 for the termination, is not shown. Each of the two end piece halves 4, 4' is fastened in the axial direction of the rotor 2 to the two adjacent moving blades 7, 7' (also called end piece blades), to be precise to the blade roots, by means of one interlocking connection 8, 8', 9, 9' each. These four interlocking connections, 8, 8', 9, 9' instead of the rotor 2, now absorb the axial forces F which are caused by the centrifugal force and the caulked wedge. In this way, axial forces no longer act on the rotor and disturbing rotor vibrations are avoided.

Figure 3:
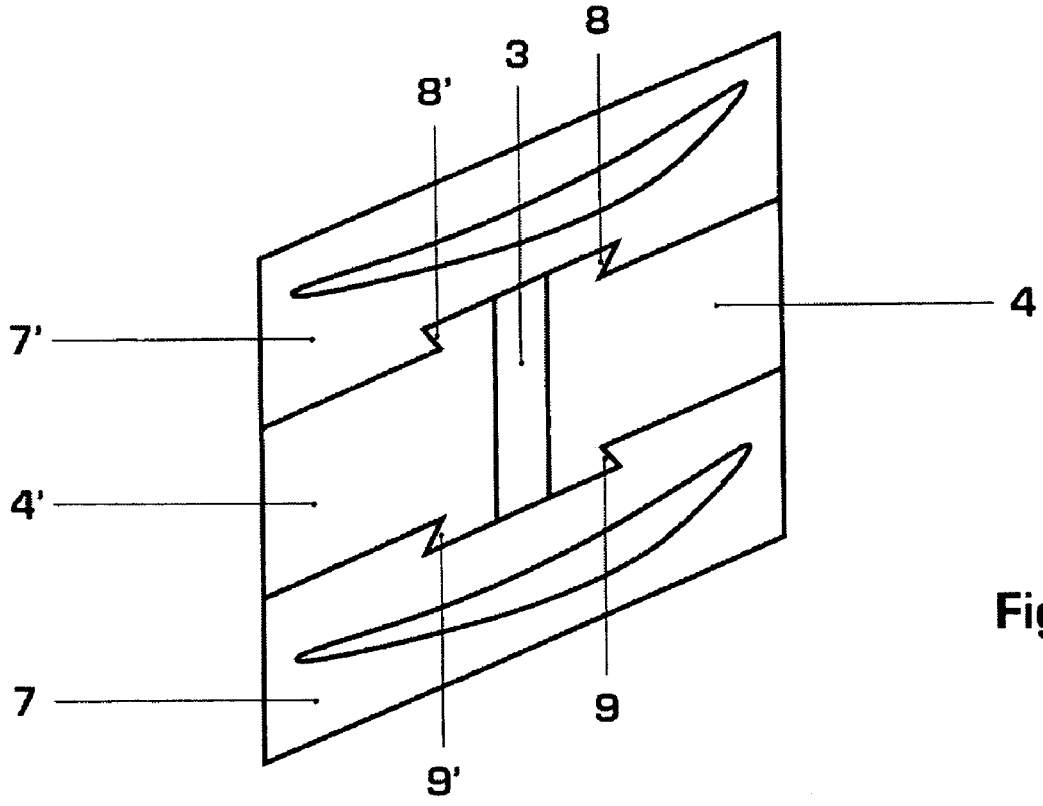
FIG. 3 shows a plan view of a schematically represented rotor end piece according to the invention with form-fitting interlocking connection after it has been installed in a compressor rotor (without wedge)

However, since there is the risk in the case of the straight interlocking connections 8, 8', 9, 9' shown in FIG. 2 of the adjacent blades 7, 7' being turned into the rotor 2 by the forces acting on them from the end piece halves 4, 4' and of said blades 7, 7' jamming during their thermal, expansion, it is better to design the interlocking connections 8, 8', 9, 9' in such a way that the end piece halves 4, 4' and the blades 7, 7' form a form-fitting subassembly, as shown in FIG. 3. The form fit is achieved here by a dovetail-like interlocking connection.

This form-fitting combination of the end pieces and the adjacent blades is referred to as an end piece pack.

Figure 4:
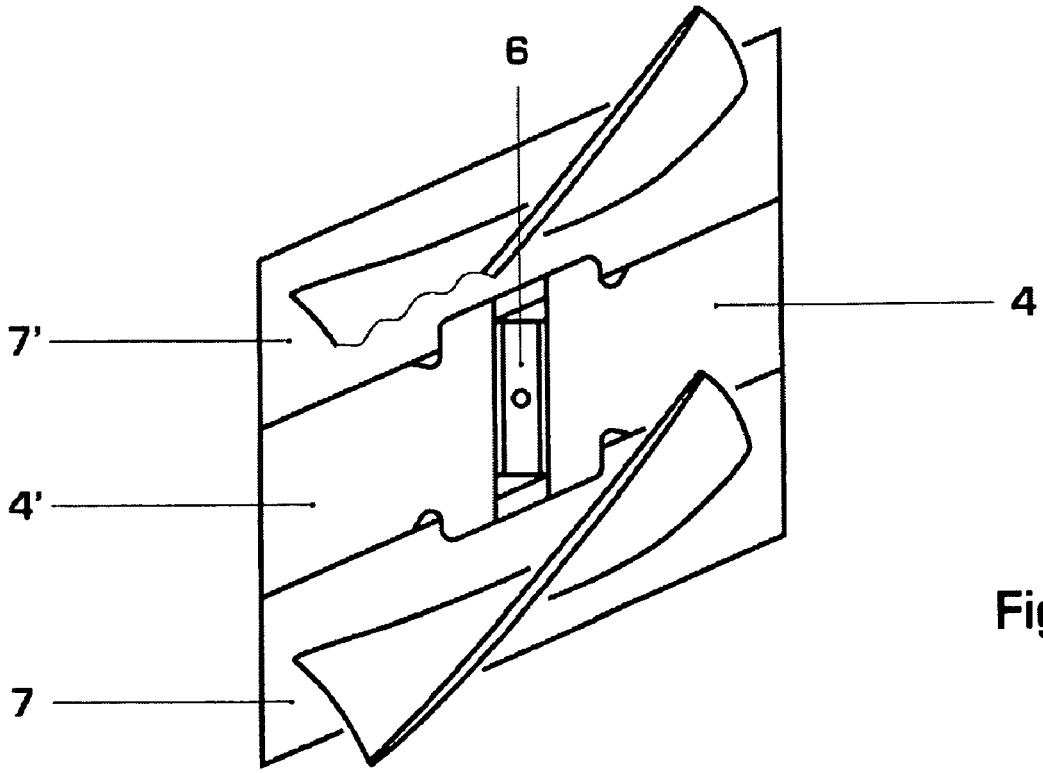
FIG. 4 shows a plan view of a schematically represented rotor end piece according to the invention with wedge with a straight interlocking connection after it has been installed in a compressor rotor.

A further exemplary embodiment is shown in FIG. 4. The figure shows an end piece pack consisting of the two end piece halves 4, 4', the caulked wedge 6 located between the end piece halves, and the two end piece blades 7, 7'.

The invention is of course not restricted to the exemplary embodiments described above.

The solution according to the invention is suitable for all blade rows in a circumferential slot. It is always advantageously used if the rotor reacts to axial forces in a sensitive manner and disturbing vibrations can arise as a result.

LIST OF DESIGNATIONS

1 Rotor end piece
2 Rotor
3' Circumferential slot
4, 4' End piece half
5, 5' Side face of the end piece half
6 Wedge
7, 7' Moving blade
8, 8' Interlocking connection
9, 9' Interlocking connection
10, 10' Lug of the wedge
11 Heart-shaped cavity
F Axial force

The invention claimed is:

1. A rotor end piece for rotors of thermal turbomachines with a circumferential slot and moving blades, the rotor end piece comprising:

two end piece halves having side faces opposite one another when in an installed state, and a wedge pushed between the two end piece halves, the wedge being form-fittingly anchored in the side faces of the end piece halves when installed, the rotor end piece configured and arranged to be positioned in an axial direction of the rotor between two adjacent moving blades;

each of the two end piece halves including an interlocking connection; and wherein each of the two end piece halves is configured and arranged to be fastened in the axial direction of the rotor to the two adjacent moving blades by said interlocking connection.

2. The rotor end piece as claimed in claim 1, each wherein interlocking connection is straight.

3. The rotor end piece as claimed in claim 1, wherein each interlocking connection comprises a form fit.

4. The rotor end piece as claimed in claim 3, wherein said interlocking form fit connection comprises a dovetail connection.

5. The rotor end piece, as claimed in claim 1, wherein the wedge includes a top end remote from the rotor longitudinal axis when in the installed state, a longitudinal slot, and two lugs separated from one another by the longitudinal slot, the lugs being spread out when in the installed state; and wherein the side faces of the end piece halves each have a top region including a recess, said recesses forming a heart-shaped cavity having walls when in the installed state, the cavity walls being covered by the spread-out lugs of the wedge, the wedge being firmly anchored in the end piece halves.

6. A system comprising:

a rotor end piece as claimed in claim 1;

a rotor having moving blades and an axial direction;

the rotor end pieces positioned in the axial direction between two adjacent moving blades and fastened in the axial direction to the two moving blades by said interlocking connection.

7. A system as claimed in claim 6, wherein said wedge is form-fittingly anchored in the side faces of the end piece halves.

8. A system as claimed in claim 7, wherein the wedge includes a top end remote from the rotor longitudinal axis, a longitudinal slot, and two spread-out lugs separated from one another by the longitudinal slot; and wherein the side faces of the end piece halves each have a top region including a recess, said recesses forming a heart-shaped cavity having walls, the cavity walls being covered by the spread-out lugs of the wedge, the wedge being firmly anchored in the end piece halves.

9. The system as claimed in claim 6, each wherein interlocking connection is straight.

10. The system as claimed in claim 6, wherein each interlocking connection comprises a form fit.

11. The system as claimed in claim 10, wherein said interlocking form fit connection comprises a dovetail connection.

12. The system as claimed in claim 6, wherein said two adjacent moving blades each comprise an interlocking connection complementary to said interlocking connection of said two end piece halves.

* * * * *